United States Patent [19]

Gates

[11] 4,194,447

[45] Mar. 25, 1980

[54] STENCIL LOADING IN STENCIL DUPLICATORS

[75] Inventor: Albert G. R. Gates, London, England

[73] Assignee: Gestetner Limited, London, England

[21] Appl. No.: 895,753

[22] Filed: Apr. 12, 1978

[30] Foreign Application Priority Data

Apr. 29, 1977 [GB] United Kingdom ..... 18132/77

[51] Int. Cl.[2] ..... B05C 17/08

[52] U.S. Cl. ..... 101/128.1; 101/132; 101/415.1

[58] Field of Search ..... 101/116, 127.1, 128.1, 101/132, 132.5, 136, 137, 127, 415.1

[56] References Cited

U.S. PATENT DOCUMENTS 3,941,054 3/1976 Springer ..... 101/127.1

FOREIGN PATENT DOCUMENTS 1185100 3/1970 United Kingdom ..... 101/127.1

*Primary Examiner*—Edgar S. Burr
*Assistant Examiner*—A. Heinz
*Attorney, Agent, or Firm*—Fleit & Jacobson

[57] ABSTRACT

The disclosure relates to a stencil duplicator having a loading device in the form of a pair of guide members which are mounted for movement between a first position in which they define a slot into which a stencil can readily be inserted to attain a predetermined position and a second position in which they define a narrower slot and hold the stencil heading strip close to the surface of the rotatable ink screen of the duplicator and in the path of movement of mounting pins carried by the stencil mounting bar on the ink screen so that when the pins next pass the guide members they enter holes in the stiff heading strip of the stencil and drag the stencil through the slot and onto the surface of the ink screen without any need to stop the machine.

Preferably the guide members present elongate edge portions which are undulated to define recesses, through which in the second position of the guide members the pins may pass, and fingers between said recesses to hold the stencil heading strip adjacent each recess.

12 Claims, 3 Drawing Figures

STENCIL LOADING IN STENCIL DUPLICATORS

The present invention relates to a device for assisting in loading a stencil onto a rotatable support of a stencil duplicator.

When, in using even an "automatic" stencil duplicator, it is desired to terminate printing with one stencil and to start printing with a fresh one, a tedious and time consuming procedure usually has to be adopted. The machine cylinders are first stopped from rotating, the top cover then moved to an open position and the cranking handle is rotated so that the stencil attaching bar is uppermost. The used stencil is then removed (if it has not already been ejected by means of an automatic stencil remover) and the fresh stencil is then manually attached to the stencil attaching bar. The cranking handle is again rotated to wind the ink screen round until the stencil has become adhered onto the screen around the top cylinder. Once the stencil is wound onto the top cylinder and the stencil backing sheet has been removed, usually only after several proofing turns of the ink screen have been performed by manually winding the ink screen round using the cranking handle, the top cover can be closed and the starting switch operated to commence copy reproduction.

As well as being time consuming and tedious, the above procedure necessitates stopping the machine cylinders prior to loading of a fresh stencil onto the machine and there is little by way of preparation for the loading of a new stencil which can be done while the duplicator is still printing with an inky preceding stencil.

Offset printing machines and spirit duplicators have been available for many years with a loading facility which allows the paper offset plate or spirit duplicating master to be attached to a leading edge plate clamp while the machine is already rotating, although in many cases the rate of rotation has to be slowed down for this to be achieved. Examples of prior systems with this facility include the machines disclosed in British Patent Specification No. 389,374 (Ritzerfeld), U.S. Pat. No. 2,002,321 (Kluitmann) and British Patent Specification No. 374,665 (Kluitmann). Such systems operate satisfactorily using the relatively stiff paper masters traditionally employed in offset printing and spirit duplicating but are totally unsatisfactory for use with a limp stencil of fibre-reinforced waxy construction.

Until now stencil loading, in view of the limp nature of the stencil material, has only been possible starting from a stationary configuration of the stencil cylinders, as for example in British Patent Specifications Nos. 1,185,100 and 1,483,401 (Gestetner Limited).

It is an object of the present invention to provide a stencil duplicator in which an automatic stencil loading facility can be provided to enable the limp stencil to be loaded onto the ink screen or other rotatable support without the need to stop the machine.

According to the present invention we provide a stencil duplicator having a rotatable support for carrying a stencil during printing, a plurality of pins positioned to engage the perforated relatively stiff heading strip of an otherwise limp stencil to hold the stencil on the rotatable support during printing, and a device for loading a stencil onto the rotatable support, the stencil loading device comprising a pair of guide members movable between a first position in which a leading edge of a stencil can be registered in a predetermined position spaced from the surface of the rotatable support and a second position in which the guide members will hold the leading edge of the stencil in a position where during rotation of the rotatable support said pins carried by the rotatable support can sweep past the guide members and enter holes disposed along the perforated leading edge portion of the stencil thereby entraining the stencil to be wound onto the rotatable support, wherein said guide members are pivotable relative to one another and providing a nip through which the leading edge of a stencil is inserted for loading, and wherein the guide members are provided with stops arranged so that when in said first position they define a nip of a given height to facilitate insertion of a stencil and when in said second position they define a height to the nip which is smaller than said given height, so that the guide members co-operate to tension the stencil as it is dragged through the nip and is wound onto the rotatable support.

Preferably the guide members comprise plates extending transversely across the stencil duplicator along a direction parallel to the axis of rotation of the rotatable support adjacent the plates, and each present an undulating edge defining recesses through which the pins of said rotatable support can pass to entrain suitably disposed holes in the stencil heading and also fingers disposed between adjacent ones of said recesses to support the stencil adjacent the holes of said heading strip in which the pins are to engage. More preferably the guide members are pivotable relative to one another and relative to the surface of the rotatable support about an axis substantially parallel to that of the rotatable support.

Thus, with the guide members in the first position, the stencil can be pre-positioned with respect to the rotatable support while being clear of the path movement of the stencil carrier pins so that this pre-positioning can take place while another stencil is still on the rotatable support and being used for printing. Then, once the other stencil has been ejected without stopping the rotatable support (using a stencil ejecting system which is well known per se), movement of the guide arrangement to the second position will place the leading edge portion of the stencil in a position where, once the rotatable support has rotated to a position where the pins are registered in the holes provided across the leading edge portion of the stencil, the stencil heading becomes automatically caught on the pins. The stencil is thus wound onto the support e.g. the ink screen, by further rotation of the support without the need to stop the rotation of the rotatable support at all during the stencil loading operation.

The guide members are suitably spring biased for rotation relative to one another in the sense tending to reduce the height of the slot with stops being provided to limit this rotation of the guide members when in the first position so that the height of the slot is then sufficient to provide for easy insertion of the leading edge of the stencil into and through the slot. The spring biased action is arranged to have the effect that when the guide arrangement is in the second position the elongate portions of the guide members place the surfaces of the stencil under moderate pressure and thus provide frictional drag on the trailing portion of the stencil so that the stencil once its heading strip has been engaged by the locating pins is wound onto the rotatable support under tension. With this arrangement it is possible to omit the usual step of hand proofing the stencil once it has been wound onto the rotatable support.

Preferably, an abutment is provided to give positive registration of the leading edge or heading strip of the stencil in said predetermined position. This abutment may be an elongate rib having a surface facing the nip defined by the guide members and towards which surface, during insertion of the stencil into the nip with said guide members in their second position, the stencil is moved to abut the surface. Alternatively the abutment may comprise a rectilinear array of pins defining a stop surface extending parallel to the axis of rotation of said rotatable support. Locating pins having ramp profiles may be provided placed between the slot and the abutment to engage in transversely outermost holes in the stencil heading strip when the leading edge of the stencil heading strip is in contact with the abutment, in order to assist in positively locating the leading edge portion of the stencil in that the ramps are arranged to resist the stencil then being withdrawn through the slot. This holds the stencil in position so that the backing sheet may be removed preferably in conjunction with a straight edge for tearing the backing sheet along a line of perforation.

To facilitate the engagement of the stencil carrier locating pins in the holes provided in the stencil and the retention of the stencil by the locating pins, the locating pins are preferably provided with slots facing in the direction of normal rotation of the stencil duplicator to accommodate portions of the stencil heading strip.

The stencil loading device can conveniently be mounted on a hinged access cover of a stencil duplicator.

It will be appreciated that the stencil loading device can be incorporated in a relatively straightforward fashion in an existing stencil duplicator. For example, where the stencil loading device is provided on a hinged access cover, a hinged cover incorporating the present stencil loading device may be substituted for a previously fitted hinged cover. The locating pins of the stencil carrier may then be replaced, if necessary, so that the pins of the stencil carrier are suitable to engage in the holes in the stencil as the pins sweep past the leading edge portion of the stencil. Thus the invention also provides, an access cover for a stencil duplicator, and having an aperture through which a stencil can be inserted during loading onto the rotatable support of a stencil duplicator; an abutment surface for engagement by a rectilinear leading edge of a stencil heading strip to define a predetermined position of said heading strip; and guide members pivotally attached to said access cover for movement relative to the access cover and each mounted along a hinge axis parallel to the location of said leading edge of the stencil heading strip in said predetermined position, said guide members being arranged to pivot between a first position in which in use of the cover the leading edge of said stencil heading strip is registered in said predetermined position and disposed close to the inside surface of said access cover, and a second position in which said stencil heading strip is held further from the inside surface of said access cover, said guide members being arranged so that in the said second position the guide members define a nip which is narrower than the corresponding nip when in said first position.

The invention will be further described with reference to the accompanying drawings in which.

Figure 1:
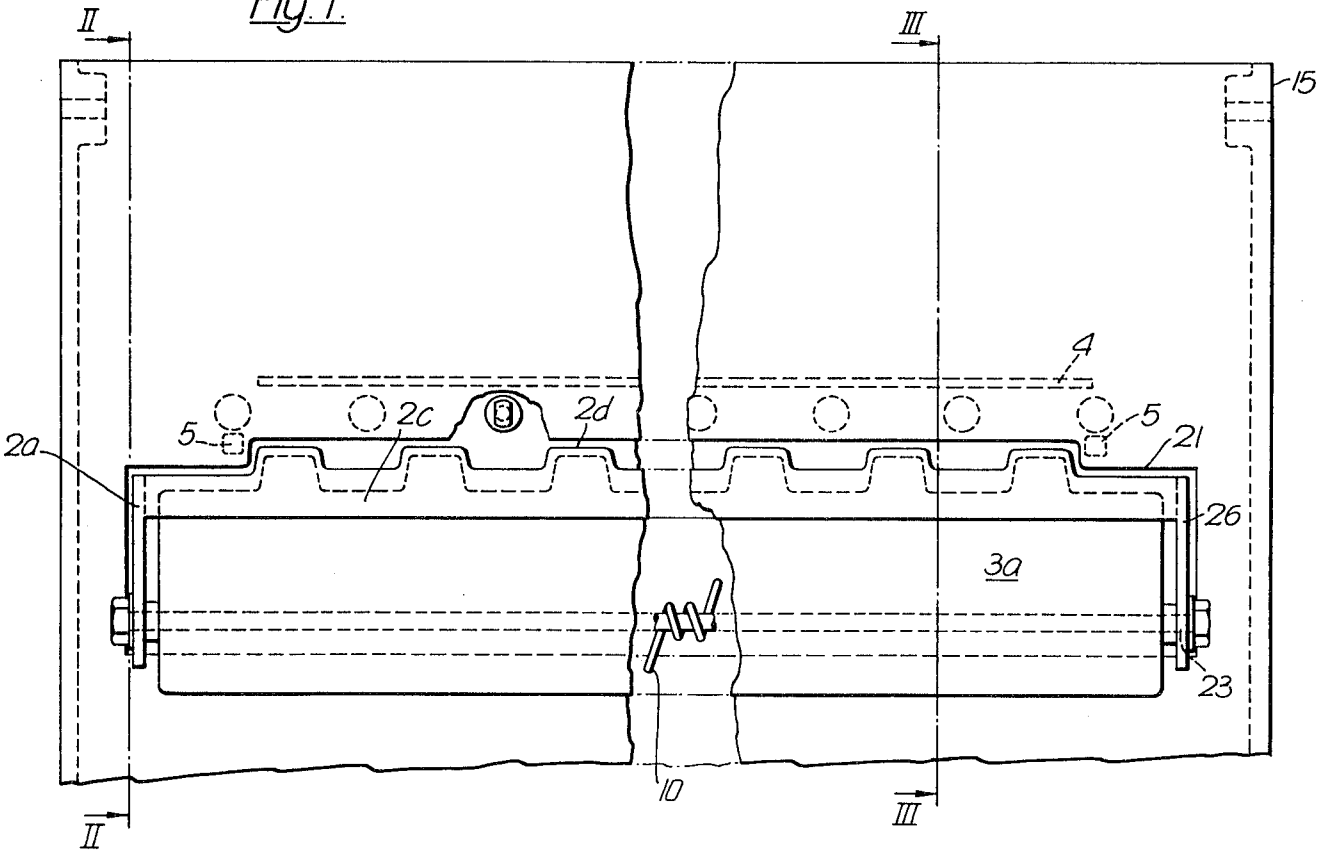
FIG. 1 is a somewhat schematic plan view of the lid and upper cylinder of a stencil duplicator incorporating a stencil loading device embodying the invention.

In the embodiment of the invention shown in the drawings, a die-cast, hinged access cover 1 of a stencil duplicator is provided with a hinge lug 15 by means of which it is hinged to the body of the duplicator and comprises two spaced apart flat coplanar portions 1*a*, 1*c* interconnected by means of a part-cylindrical portion 1*b* which is arranged so that when the access cover is in the closed position, the cylindrical portion 1*b* extends longitudinally of and part-way round the top cylinder 9 of the stencil duplicator.

The top cylinder 9 is rotatable by drive means (not shown) and during printing carries a stencil 20 on its periphery; a further lower cylinder (not shown) cooperates with the upper cylinder to define a nip through which copy sheets pass as they are being printed. The conventional narrow stiff stencil heading strip 20*a* is provided with a plurality of spaced apart holes disposed across and adjacent to the leading edge of the stencil. Mounted on the periphery of the top cylinder 9 is a stencil carrier 8 on the ink screen 8*a* and provided with radially outwardly extending longitudinally spaced attaching pins 7. When the stencil is loaded onto the top cylinder 9, these attaching pins 7 each engage in respective ones of the holes formed across the leading edge of the stencil. To provide a more positive engagement the pins are each provided with a recess 7*a* which faces in the direction of rotation of the duplicator ink screen on the top cylinder 9 during printing, and a further recess 7*b* which faces away from the direction of rotation of the ink screen 8*a*; these recesses 7*a*, 7*b* can be rectangular in cross-section, as shown, or of V-shaped or any other suitable cross-section.

As the pins 7 encounter the holes in the perforated stiff heading strip 20*a* of the stencil the strip material on the front edge of each hole (the left-hand edge as viewed in FIG. 2) will engage in the leading recess 7*a* and this will entrain the stencil 20 to start movement towards the left, i.e. onto the ink screen. As the stencil starts to move, the opposite edge of the hole will snap over the head 7*c* of the pin 7 to engage in recess 7*b*.

Located slightly to one side of the highest point of the part-cylindrical portion 1*b* of the cover 1 is a generally rectangular aperture 21 (FIG. 1) which communicates the inner and outer surfaces of the cover 1 and extends longitudinally of the top cylinder 1 across the entire longitudinal extent of the area of the outer periphery of top cylinder 9 on which a stencil is carried. It is through this aperture 21 that a stencil 20 is loaded onto the top cylinder 9.

The stencil loading device comprises a guide arrangement 22 including upper and lower injection moulded guide members, 2 and 3 respectively, mounted on the outer surface of part-cylindrical portion 1*b* of cover 1 for pivoting relative to the cover and relative to one another about an axis 23 which is substantially parallel to the longitudinal axis of top cylinder 9. As shown in FIG. 1 the guide member 2 comprises two longitudinally spaced apart arms 2*a*, 2*b* which extend radially of the axis of pivoting and an elongate bar 2*c* which extends along the length of slot 21. The bar portion 2c of upper guide member 2 has an undulating or castellated formation 2d extending across the width of the part of the top cylinder 9 on which the stencil is loaded.

Lower guide member 3 comprise a flat flap-like portion 3a which is offset from the axis of pivoting 23. The lower guide member 3 also has a castellated or undulating edge similar to that of the upper guide member 2. In each case the recesses of the undulating edge of the guide member are in line with the path of movement of one of the stencil locating pins 7 and adjacent ones of the recesses are separated by fingers which support the stiff stencil heading strip in the FIG. 3 configuration. A spring 10 (FIG. 1) engages the guide members 2 and 3 and biases the upper guide member 23 to tend to rotate anticlockwise relative to lower member 3, for a reason which will be explained below.

The bar portion 2c of upper guide member 2 and the flap portion 3a by the guide member 3 define a slot therebetween through which a stencil 20 can be inserted during prepositioning of the stencil prior to its loading onto the top cylinder 9 of the stencil duplicator.

Figure 2:
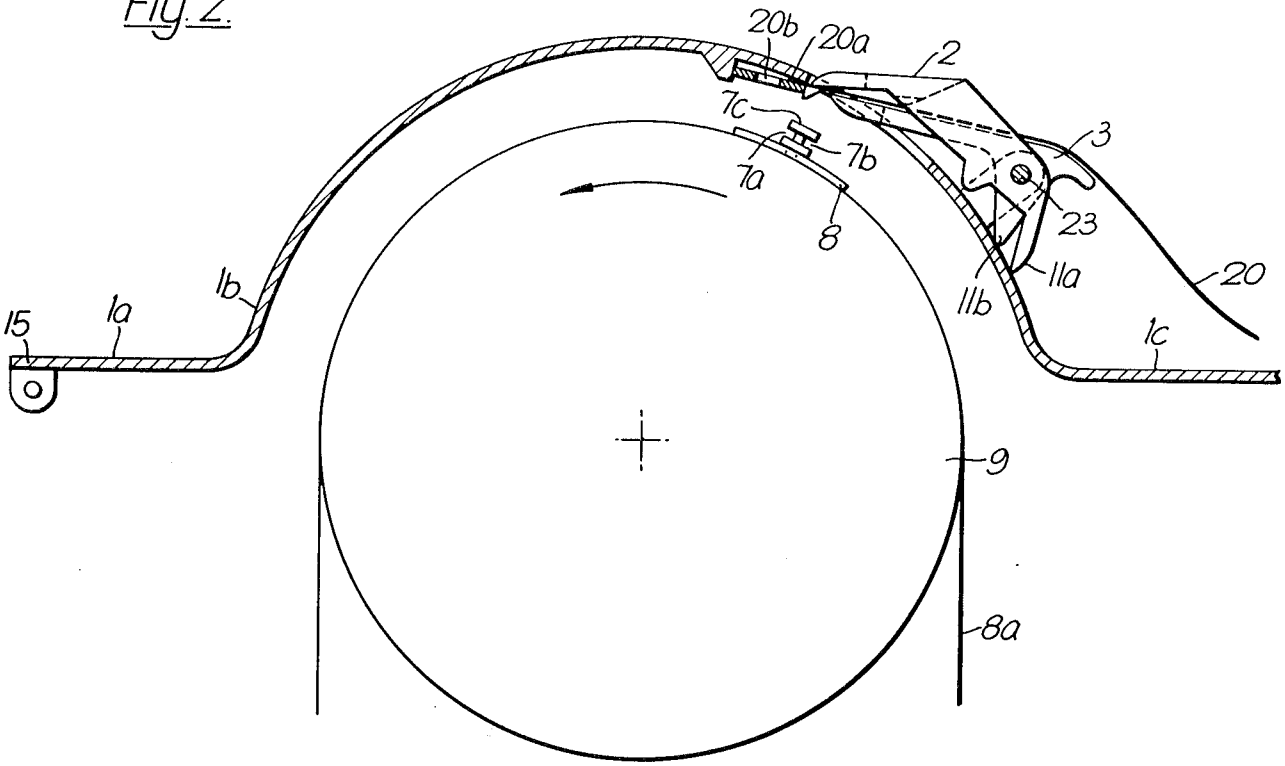
FIG. 2 is a somewhat schematic vertical section through the upper part of the stencil duplicator of FIG. 1 showing the guide assembly of the stencil loading device in its upper position.
Figure 3:
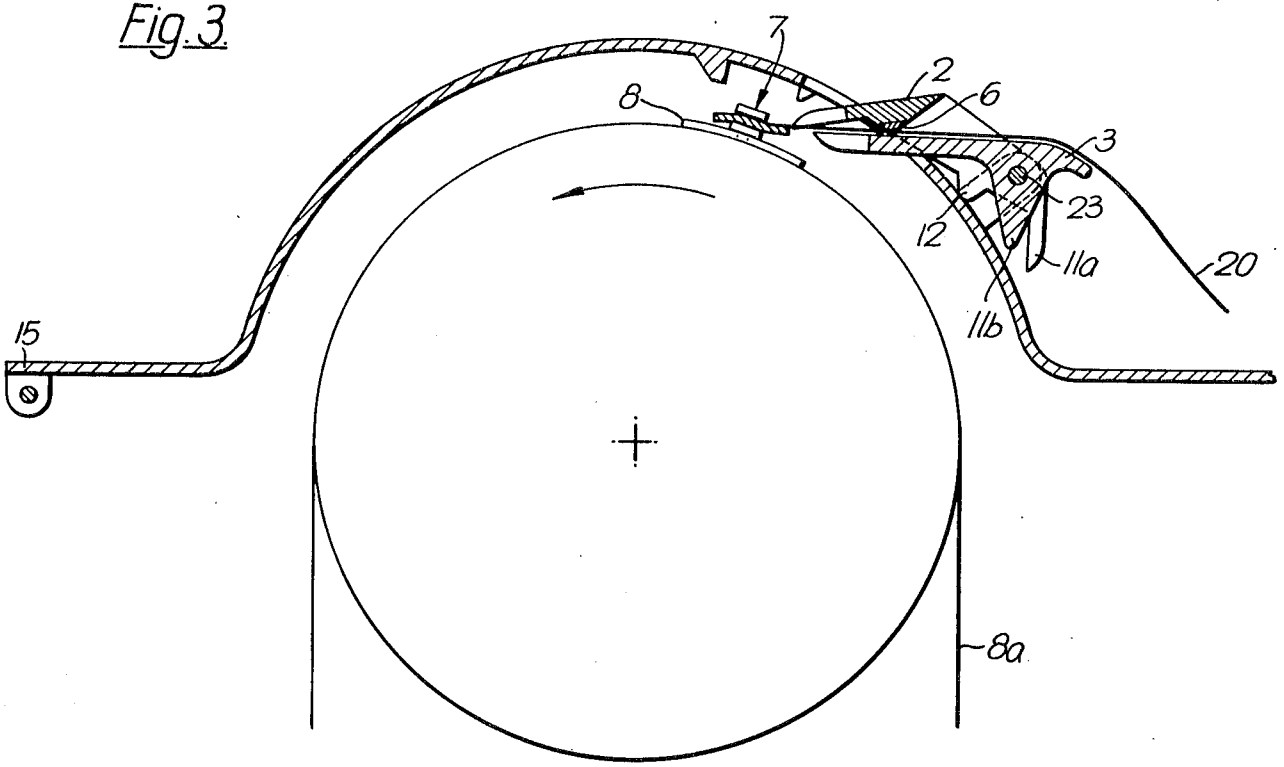
FIG. 3 is a view similar to FIG. 2 but showing the guide assembly in the lower, stencil loading position.

The stencil loading device is used as follows: with the guide members 2 and 3 in the positions shown in FIG. 2 the leading edge of the stencil 20 is inserted in the slot between the portion 2c of guide member 2 and the flap 3a of guide member 3 and is advanced in this slot so as to extend through the aperture 21 in cover 1. The leading edge of the stencil eventually comes into contact with a stencil head stop 4 which extends across the width of the stencil and is in the form of a rib directed radially inwardly of the top cylinder 9 and having a flat surface facing the slot 21 and guide arrangement 22. In this position those of the holes in the heading strip which are at the transverse edges of the stencil 20 are engaged by radially inwardly extending locating pins 5 on the inner surface of part-cylindrical portion 1b of cover 1. These pins 5 as shown in FIGS. 2 and 3 are of a "ramp" cross-section, that is to say the surface of each pin which faces the aperture 21 is shallowly inclined with respect to the adjacent feedpath of the stencil through the guide assembly 22 while the surface which faces away from the aperture 21 is perpendicular to the feedpath of the stencil so that once the leading edge of the stencil has engaged the stencil head stop 4 and the locating pins 5 have engaged in appropriate holes in the leading edge portion of the stencil, the locating pins 5 will tend to register the stencil positively in the FIG. 2 position of the stencil and will resist withdrawal of the body of the stencil back through the aperture 21 by a "ratchet" action. Thus with the guide member still in the FIG. 2 position the backing sheet (not shown) of the stencil may be gripped and torn off with the remaining body portion of the stencil being held in position by the locating pins 5. The suitably shaped undersurface 6 of the bar portion 2c of guide member 2 facilitates the tearing off of the backing sheet of the stencil.

Once in the FIG. 2 position, the heading strip 20a of the stencil 20 is in a predetermined position spaced from the path of movement of the pins 7 of the stencil carrier 8.

Throughout the above operation of pre-positioning the stencil so that it is engaged in the slot between the guide members 2 and 3 to contact the stencil head stop 4 and removing the backing sheet, the top cylinder 9 can be rotated so that pre-positioning of one stencil can take place simultaneously with the use of another stencil already on the top cylinder 9 to print copy sheets.

It will be noted that in the FIG. 2 position stops 11a, 11b provided on guide members 2 and 3 respectively engage the outer surface of the access cover 1 and limit clockwise rotation of each guide member relative to the cover 1 and thus limit the constriction of the slot between the bar portion 2c and the flap 3a so that the stencil can be freely inserted through this slot.

When it is desired to load the stencil 20 onto the stencil carrier, the guide members 2 and 3 are pivoted to the position shown in FIG. 3, e.g. by pressing on the bar portion 2c of the upper guide member 2.

Once pivoted to the FIG. 3 position, the upper guide member 2 is prevented from further anti-clockwise pivoting by engagememt of a stop 12 carried thereby and the outer surface of the access cover 1. The action of the spring 10 biases the lower guide member 3 for clockwise rotation relative to the upper guide member 2 and thus with the guide members in the FIG. 3 position, the height of the slot between the bar portion 2c and the flap 3a is reduced so that the stencil is gripped, under moderate pressure, between the guide members 2 and 3 to drag on the stencil 20 as it is being wound onto the ink screen 8a. This dragging action is a gentle influence on the delicate stencil in that the underside of the bar portion 2c includes a sponge rubber pad 2d which presses on the delicate upper face of the stencil, this being the side against which the copy paper sheet is pressed by the impression cylinder during printing.

Pivoting of the guide members 2 and 3, with the heading strip of the stencil therebetween, to the FIG. 3 position causes the heading strip 20a of the stencil to come into close proximity with the ink screen 8a on the top cylinder 9. As the top cylinder 9 rotates in the anticlockwise direction, as shown, the attaching pins 7 engage the adjacent portion of the stencil heading strip and enter the holes provided across the heading strip 20a of the stencil 20. With the attaching pins 7 engaged in the holes such that the front edge of each hole is engaged, as shown in FIG. 3, in the front slot 7a of the respective pin 7, the stencil 20 is dragged through the slot between guide members 2 and 3 so that it snaps over the head 7c of pin 7 to engage in the rear recess 7b. The action of spring 10 tending to reduce the height of the slot between guide members 2 and 3 means that frictional engagement between the guide members and the surface of the stencil 20 will be such as to provide the necessary tension to smooth the stencil 20 onto the ink screen 8a on the top cylinder 9, without damaging the stencil. The castellated formations 2d on the leading edge of bar portion 2c of guide member 2 and corresponding formations on the leading edge of the flap 3a of guide member 3 serve to allow passage of the stencil carrier pins so that the guide members 2 and 3 can be supported as close as possible to the ink screen 8a on the top cylinder 9 and to assist in the entrainment of the stencil. Smoothing friction on the stencil as it is wound onto the ink screen, such that no further hand proofing of the stencil is required once in situ on the top cylinder 9, results from the sponge rubber pad 2d pressing the stencil down onto the lower guide member 3.

The pivoting of the guide members 2 and 3 from the FIG. 2 to the FIG. 3 position may take place either manually or automatically e.g. under the control of one or more solenoids. The solenoid(s) could of course be mounted on the cover 1 or be mounted on the main body of the duplicator. In the latter case, the solenoid(s) or the guide members could be provided with projections extending through the cover 1 and drivingly connecting the solenoid(s) to the guide members only when the cover is in the closed positions. Suitable positions for solenoids are at each of the ends of the guide members 2, 3. As indicated above, the stencil may be introduced to the pre-loading position shown in FIG. 2 while a previous stencil is still being used for printing, and the solenoid(s) required to move the guide members 2 and 3 from the FIG. 2 to the FIG. 3 position can be operated by a device responsive to completion of a pre-programmed number of copies from the previous stencil. The required removal of a stencil prior to loading of a fresh stencil onto the top cylinder 9 can also take place automatically once the pre-programmed number of copies as counted by the copy counter have been run off, for example by means of an automatic stencil ejector. A stencil ejector such as the one described in our copending Patent Application No. 3094/76 could, for example, be used with the modification that the U-shaped pivotable clamp which holds the stencil heading is replaced by a pivotal flap with castellated formations accommodating the stencil carrier pins, this flap in use being located between the stencil carrier 8 and the stencil heading strip 20*a* during printing and being pivoted away from the stencil carrier 8 when stencil ejection is required, to force the stencil heading strip 20*a* clear of the attaching pins.

I claim:

1. A stencil duplicator having rotatable support means rotatable about an axis and having a surface for carrying a stencil having a relatively stiff heading strip with holes therein, a plurality of pins carried by said rotatable support means to engage said heading strip of the stencil to hold the stencil on the rotatable support means during printing, and means for loading said stencil onto said rotatable support means, the loading means comprising:

(a) a pair of guide members;

(b) means mounting said guide members for pivotal movement between a first position in which said heading strip of the stencil can be registered in a predetermined position spaced from said surface of the rotatable support means, and a second position in which the guide members will hold the heading strip of the stencil in a location through which location said pins travel during rotation of the rotatable support means, whereby when the stencil is in said location said pins carried by the rotatable support can sweep past said guide members and enter said holes in the heading strip of the stencil thereby entraining the stencil to be wound onto said surface of the rotatable support;

(c) edge means on both said guide members defining a nip through which said heading strip of the stencil may be inserted for loading; and (d) stop means on said guide members positioned to hold said guide members with said nip having a width which is greater in the first position of said guide members than in said second position thereof to facilitate insertion of a stencil in said first position and to tension the stencil as it is dragged through the nip and is wound onto the rotatable support means in said second position.

2. A stencil duplicator according to claim 1, wherein said guide members comprise plates extending transversely across the stencil duplicator along a direction parallel to the axis of rotation of the rotatable support adjacent said plates, and said edge means define an undulating edge along each said plate to present recesses through which the pins of said rotatable support means can pass to entrain said holes in the stencil heading strip and fingers disposed between adjacent ones of said recesses to support the stencil heading strip adjacent said holes of said heading strip in which the pins are to engage.

3. A stencil duplicator according to claim 1 wherein said means pivotally mounting the guide members comprise means for permitting pivotal movement thereof about an axis substantially parallel to that of the rotatable support means.

4. A stencil duplicator according to claim 3, and including spring means biasing said guide members for rotation relative to one another in the sense tending to reduce said width of said nip.

5. A stencil duplicator according to any one of claims 1 to 4 and including abutment means defining positive registration of said heading strip of the stencil in said predetermined position.

6. A stencil duplicator according to claim 5, wherein said abutment comprise an elongate rib having a surface facing the nip defined by the guide members and towards which surface, during insertion of the stencil into the nip with said guide members in their second position, the stencil is moved into abutment with the surface.

7. A stencil duplicator according to claim 5, and including means to resist withdrawal of said stencil from said nip along a direction opposite to that along which it was moved during insertion.

8. A stencil duplicator according to claim 7, wherein said withdrawal resisting means comprise locating pins which are placed between the nip and the abutment to engage in transversely outermost ones of said holes in the stencil heading strip when the leading edge of the stencil heading strip is in contact with the abutment and which have ramp profile means oriented so as to guide said heading strip over said pins but to resist withdrawal of the stencil in the reverse direction through the said nip.

9. A stencil duplicator according to any one of claims 1 to 4, wherein said pins carried by the rotatable support means are provided with slots facing in the direction of normal rotation of the stencil duplicator to accommodate portions of the stencil heading strip bordering on the holes in which the pins locate.

10. A stencil duplicator according to claim 9, wherein said pins carried by the rotatable support means further include slots facing away from the direction of normal rotation of the stencil duplicator.

11. A stencil duplicator according to any one of claims 1 to 4, wherein said guide members are pivotally carried by an access cover which normally conceals the rotatable support of the duplicator, said access cover including an elongate aperture extending parallel to the axis of rotation of each guide member to allow a stencil to be inserted through the aperture and into the nip formed between the guide members.

12. A stencil duplicator according to claim 11 wherein said withdrawal resisting means comprise locating pins which are placed between the nip and the abutment to engage in transversely outermost ones of said holes in the stencil heading strip when the leading edge of the stencil heading strip is in contact with the abutment and which have ramp profile means being oriented so as to guide said heading strip of the stencil over said pins but to resist withdrawal of the stencil in the reverse direction through the said nip; and wherein said locating pins and the abutment are provided on the inner surfaces of said access cover.

* * * * *